US008203087B2

(12) United States Patent
Hu et al.

(10) Patent No.: US 8,203,087 B2
(45) Date of Patent: Jun. 19, 2012

(54) KEY ASSEMBLY USED IN AN ELECTRONIC DEVICE

(75) Inventors: Wang-An Hu, Shanghai (CN); Jian-Jun Liu, Shanghai (CN); Li Sun, Shanghai (CN); Kuo-Wei Hung, Taipei Hsien (TW); Rong Li, Shanghai (CN)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 250 days.

(21) Appl. No.: 12/728,253

(22) Filed: Mar. 21, 2010

(65) Prior Publication Data

US 2011/0083952 A1 Apr. 14, 2011

(30) Foreign Application Priority Data

Oct. 14, 2009 (CN) ..... 2009 2 0312482 U

(51) Int. Cl.
*H01H 19/00* (2006.01)

(52) U.S. Cl. ..... 200/6 R

(58) Field of Classification Search ..... 200/5 A, 200/6 R, 6 A, 339, 5 R, 4, 17 R, 18, 14, 329, 200/336

See application file for complete search history.

(56) References Cited

U.S. PATENT DOCUMENTS

| | | | | |
|---|---|---|---|---|
| 5,621,196 | A * | 4/1997 | Nishijima et al. | 200/6 A |
| 7,193,166 | B2 * | 3/2007 | Sakurai | 200/5 R |
| 7,459,646 | B1 * | 12/2008 | Shi | 200/5 R |
| 7,507,919 | B2 * | 3/2009 | Sugahara et al. | 200/6 A |
| 7,884,291 | B2 * | 2/2011 | Terao | 200/6 A |

* cited by examiner

*Primary Examiner* — Edwin A. Leon
(74) *Attorney, Agent, or Firm* — Altis Law Group, Inc.

(57) ABSTRACT

A key assembly used in an electronic device includes a printed circuit board (PCB) including two optical couplers, a key body and a supporting assembly. The key body is rotatably supported on the PCB and includes a circular disk and a plurality of teeth. The plurality of teeth extend from periphery edge of the circular disk toward the PCB and are spaced apart from each other. The supporting assembly supports the key body on the PCB. When the key body is rotated, the plurality of teeth interact with the two optical couplers to generate one or more control signals to control corresponding one or more operations of the electronic device.

14 Claims, 7 Drawing Sheets

KEY ASSEMBLY USED IN AN ELECTRONIC DEVICE

BACKGROUND

1. Technical Field

The present disclosure generally relates to electronic devices, and more particularly to a key assembly used in an electronic device.

2. Description of Related Art

Electronic devices, such as personal digital assistants (PDA), mobile phones, set-top boxes, often utilize a multi-direction key to control different operations. Generally, the multi-direction key comprises four function keys respectively indicating up, down, left, and right directions, and an OK key. However, due to the increasing diversity of functions of the electronic device, more additional function keys, such as a game key and a camera key are needed. The additional function keys greatly complicate the manufacturing process and increase cost of the electronic device.

Therefore, a need exists in the industry to overcome the described limitations.

DETAILED DESCRIPTION

Figure 1:
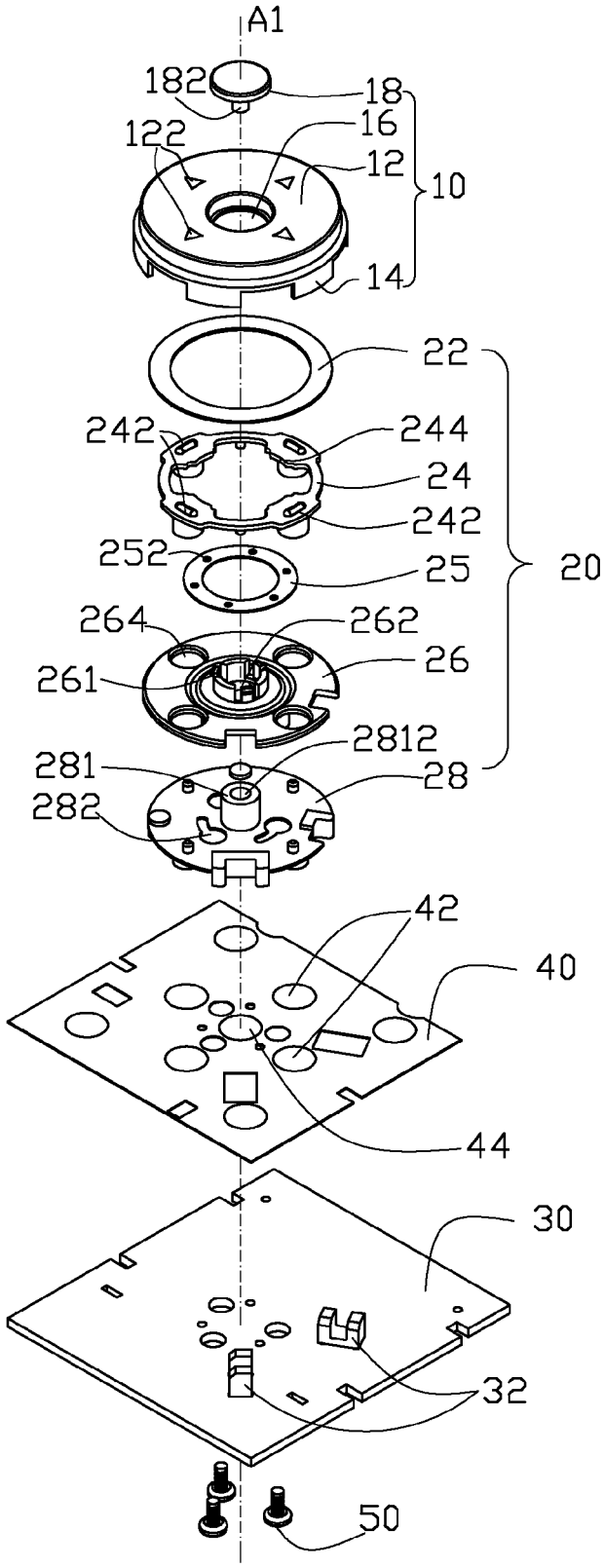
FIG. 1 is an exploded, isometric view of a key assembly used in an electronic device of an exemplary embodiment of the disclosure.
Figure 2:
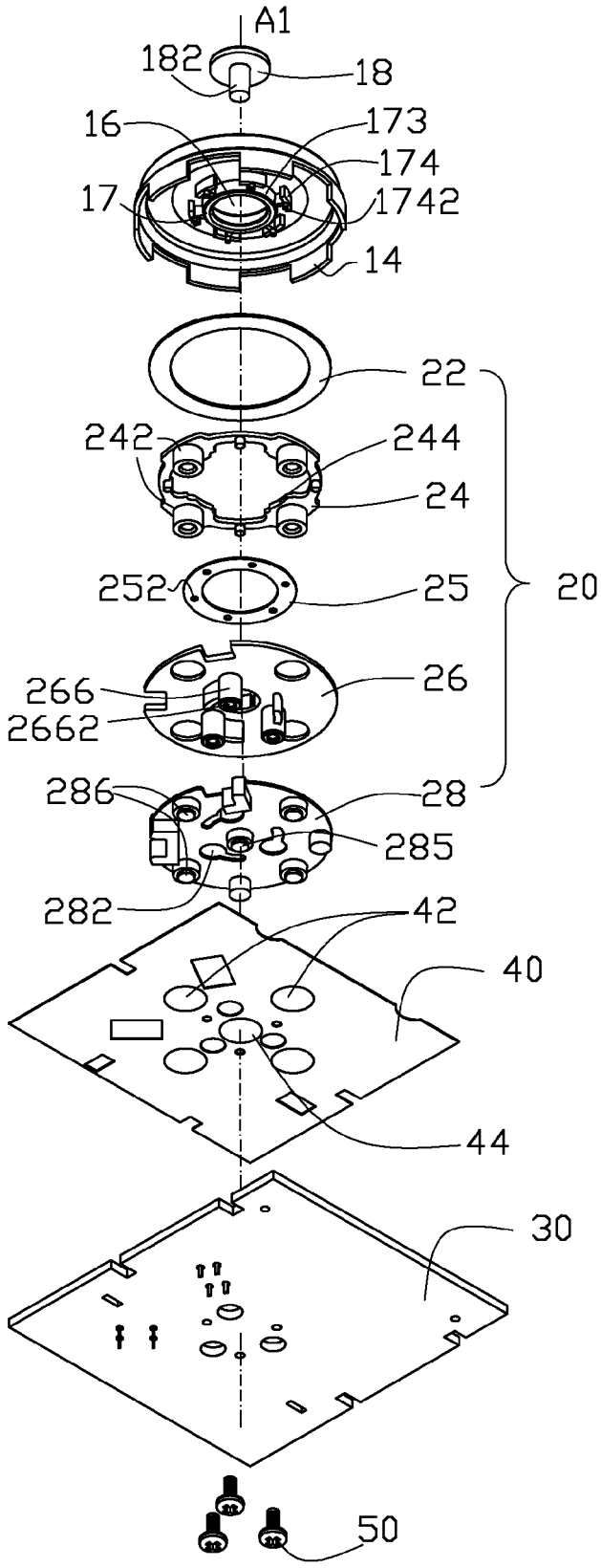
FIG. 2 is similar to FIG. 1, viewed from another aspect.

Referring to FIG. 1 and FIG. 2, a key assembly used in an electronic device comprises a key body 10, a supporting assembly 20, and a printed circuit board (PCB) 30. The PCB 30 comprises two optical couplers 32 and a switch unit 40. The supporting assembly 20 rotatably supports the key body 10 on the PCB 30. The key body 10 comprises a circular disk 12 and a plurality of teeth 14 extending from periphery edge of the circular disk 12 toward the PCB 30 and spaced apart from each other. When the key body 10 rotates about a shaft Al that passes through the center of the circular disk 12 and is perpendicular to the PCB 30, the plurality of teeth 14 interact with the two optical couplers 32 to generate one or more control signals to control a corresponding one or more operations of the electronic device. The key body 10 is in frictional engagement with the supporting assembly 20 to damp rotation of the key body 10 under an external force so as to improve user experience and prevent unnecessary rotation of the key body 10.

The circular disk 12 of the key body 10 comprises a plurality of direction key portions 122 distributed centrosymmetrically. The key body 10 defines a hole 16 at the center thereof to receive a center key 18 that is supported on the supporting assembly 20. In one embodiment, the center key 18 can be an OK key, which is a key that allows user confirmation of messages of the electronic device.

Figure 3:
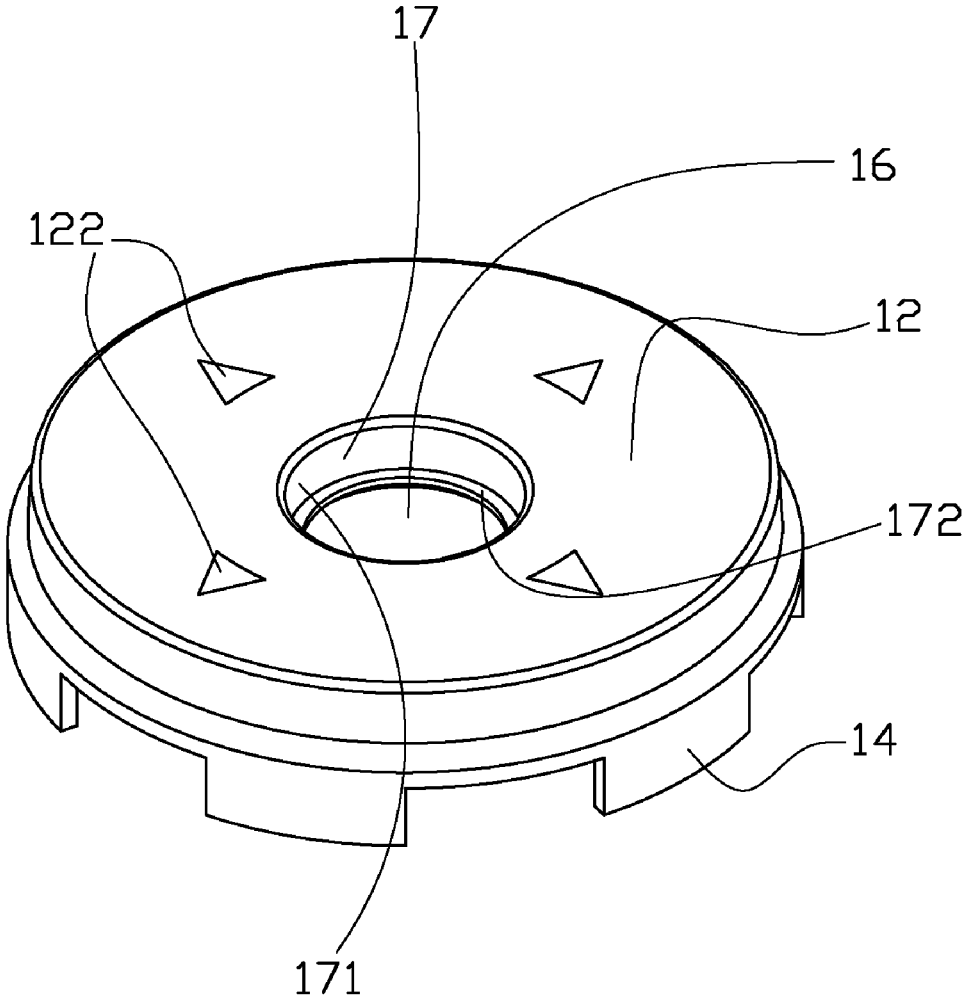
FIG. 3 is an enlarged view of a key body of the key assembly of FIG. 1.
Figure 4:
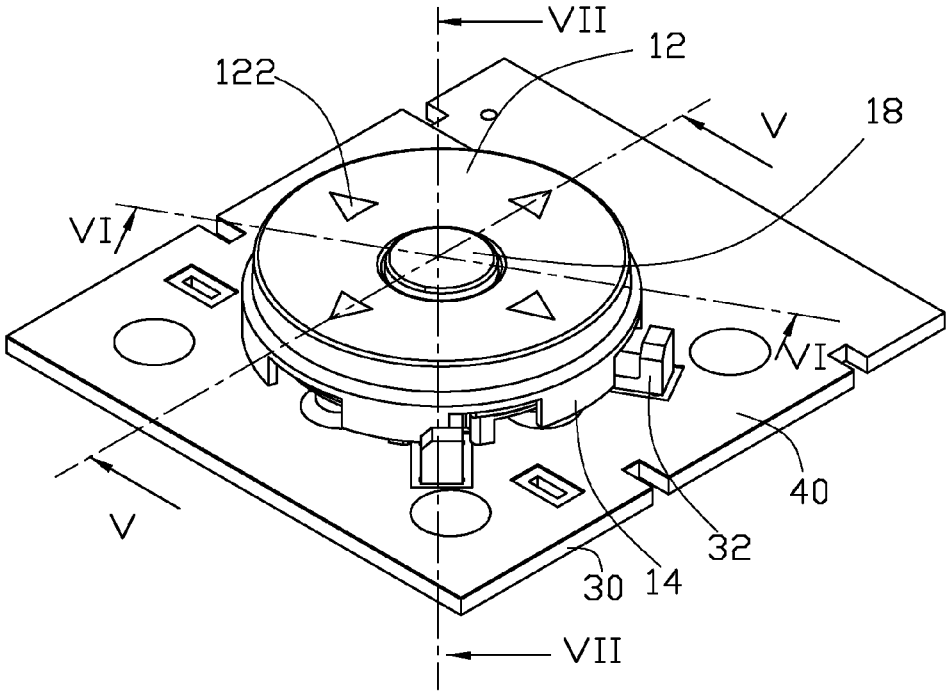
FIG. 4 is an assembled perspective view of the key assembly of FIG. 1.
Figure 5:
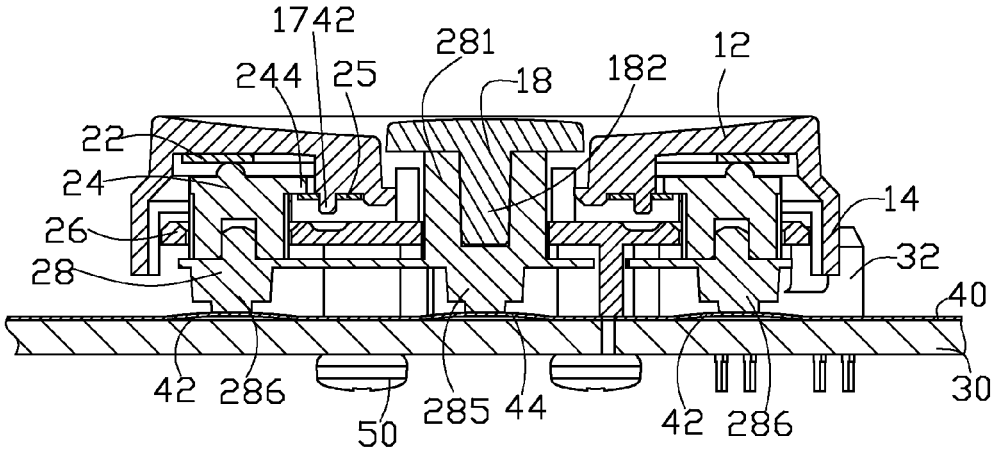
FIG. 5 is a cross-section view along line V-V of FIG. 4.
Figure 6:
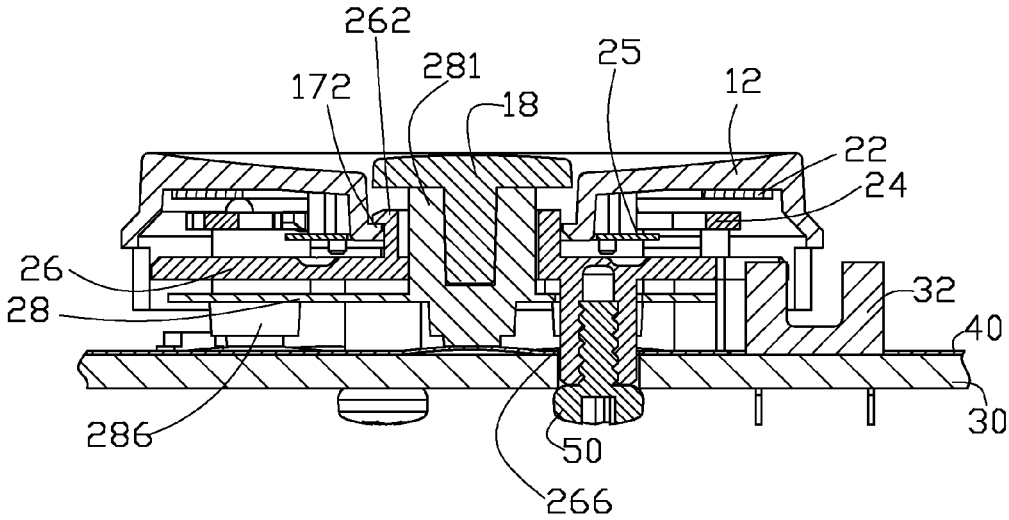
FIG. 6 is a cross-section view along line VI-VI of FIG. 4.
Figure 7:
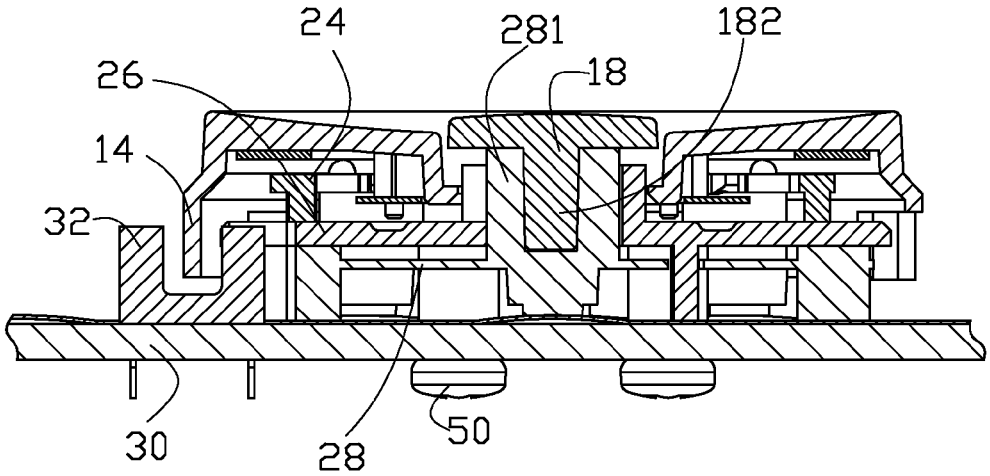
FIG. 7 is a cross-section view along line VII-VII of FIG. 4.

Referring to FIG. 3, the key body 10 further comprises a positioning ring 17 disposed around the hole 16 and extending from the circular disk 12 toward the PCB 30. The positioning ring 17 comprises a step portion 172 extending inward from an inner surface 171 of the positioning ring 17 and a plurality of projections 174 extending outward from an outer surface 173. Each of the plurality of projections 174 comprises a positioning pin 1742. In this embodiment, the step portion 172 is annularly shaped, and the plurality of projections 174 are evenly spaced apart from each other.

The switch unit 40 comprises a plurality of first dome switches 42 corresponding to the plurality of direction key portions 122 and a second dome switch 44 corresponding to the center key 18. The plurality of first dome switches 42 and the second dome switch 44 are configured to sense a plurality of contact signals generated in response to pressing manipulations on the plurality of direction key portions 122 and the center key 18.

The supporting assembly 20 comprises a sliding plate 22, a touch ring 24, a fixing plate 25, a supporting member 26 and a rubber disk 28.

Referring to FIG. 4-FIG. 7, the touch ring 24 is rotatably disposed around the plurality of projections 174 of the positioning ring 17. The touch ring 24 comprises a plurality of touch portions 242, corresponding to the plurality of direction key portions 122 respectively, and at least one pair of positioning flanges 244 configured on an inner flange of the touch ring 24. In this embodiment, the quantity of the positioning flanges 244 is equal to that of the touch portions 242, and each of the positioning flanges 244 extends from the corresponding touch portion 242 toward the center of the touch ring 24.

The fixing plate 25 defines a plurality of positioning holes 252 corresponding to the plurality of positioning pins 1742 respectively. The fixing plate 25 is fixed on the key body 10 via the positioning holes 252 engaging with the positioning pins 1742. The positioning flanges 244 of the touch ring 24 are partly supported on the fixing plate 25, thereby the touch ring 24 is positioned between the key body 10 and the fixing plate 25. The fixing plate 25 is fixed on positioning pins 1742 of the key body 10 by hot melt or bonding.

The sliding plate 22 is disposed between the touch ring 24 and the circular disk 12 of the key body 10 to achieve a smooth rotation of the key body 10 under an external force.

The supporting member 26 defines a central hole 262 and a plurality of through holes 264 distributed around the central hole 262, and comprises a plurality of elastic hooks 261 disposed around the central hole 262 and at least one fixing post 266 located between the central hole 262 and the through holes 264. The elastic hooks 261 protrude from one side of the supporting member 26 to engage with the step portion 172 of the key body 10, thereby the key body 10 is installed on the supporting member 26. The at least one fixing post 266 protrudes from the other side of the supporting member 26 and is used to secure the supporting member 26 to the PCB 30. The plurality of through holes 264 receives the plurality of touch portions 242 respectively. The at least one fixing post 266 each defines a screw hole 2662, which matches a screw 50 to fix the supporting member 26 on the PCB 30.

The rubber disk 28, located between the supporting member 26 and the PCB 30, comprises a central convex stage 281, a plurality of first padding blocks 286 corresponding to the plurality of first dome switches 42 and a second padding block 285 corresponding to the second dome switch 44. The rubber disk 28 defines at least one fixing hole 282 to receive the at least one fixing post 266 therethrough, that is, the at least one fixing post 266 extends through the at least one fixing hole 282, the switch unit 40 and eventually to the PCB 30 to fix the supporting assembly 20 on the PCB 30.

The central convex stage 281 extends from one side of the rubber disk 28 and is inserted into the central hole 262 of the supporting member 26 to engage with the center key 18. In this embodiment, the center key 18 comprises a positioning post 182, which engages with a positioning hole 2812 defined in the central convex stage 281. The plurality of first padding blocks 286 and the second padding block 285 extend from the other side of the rubber disk 28. In the embodiment, the plurality of first padding blocks 286 contact with the plurality of first dome switches 42 respectively, and the second padding block 285 contacts the second dome switch 44.

The plurality of touch portions 242 of the touch ring 24 extend through the plurality of through holes 264 of the supporting member 26 and are supported on the rubber disk 28. The touch ring 24 and the rubber disk 28 are made of elastic rubber material. As pressure is applied to the center key 18, the second dome switch 44 is turned on via the second padding block 285 being pressed and deformed under the pressure. When the pressure is released, the center key 18 is returned to its original position under an elastic force of the second padding block 285.

Similarly, as pressure is applied to one of the plurality of direction key portions 122, the corresponding first dome switch 42 is turned on via the corresponding the touch portion 242 of the touch ring 24 and the corresponding first padding block 286 being pressed and deformed under the pressure. When the pressure is released, the pressed key portion 122 is returned to its original position under an elastic force of the corresponding the touch portion 242 and the corresponding first padding block 286.

The key body 10 is installed to the supporting assembly 20, which is fixed to the PCB 30 and rotatably coupled to the two optical couplers 32 on the PCB 30 to generate one or more control signals to control corresponding one or more operations of the electronic device. Furthermore, the key body 10 can turn on the switch unit 40 via providing pressure thereon. Therefore, the key assembly controls more operations, while at the same time reducing size and cost of the electronic device.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A key assembly used in an electronic device, comprising:

a printed circuit board (PCB) comprising two optical couplers;

a key body, rotatably supported on the PCB, and comprising a circular disk and a plurality of teeth extending from periphery edge of the circular disk toward the PCB and spaced apart from each other; and a supporting assembly to support the key body on the PCB;

wherein when the key body is rotated, the plurality of teeth interact with the two optical couplers so as to generate one or more control signals to control corresponding one or more operations of the electronic device.

2. The key assembly as claimed in claim 1, wherein the circular disk comprises a plurality of direction key portions distributed centrosymmetrically, and the PCB further comprises a switch unit, which comprises a plurality of first dome switches corresponding to the plurality of direction key portions.

3. The key assembly as claimed in claim 2, wherein the key body further comprises a center key received in a hole defined at center of the key body and supported on the supporting assembly, and the switch unit comprises a second dome switch corresponding to the center key.

4. The key assembly as claimed in claim 3, wherein the key body further comprises a positioning ring disposed around the hole and extending from the circular disk toward the PCB, and the positioning ring comprises a step portion extending inward from an inner surface thereof to install the key body on the supporting assembly.

5. The key assembly as claimed in claim 4, wherein the positioning ring comprises a plurality positioning pins, and the supporting assembly comprises a touch ring rotatably disposed around the positioning ring and a fixing plate defining a plurality of positioning holes, wherein the touch ring is positioned between the key body and the fixing plate fixed on the key body via the positioning holes engaging with the positioning pins.

6. The key assembly as claimed in claim 5, wherein the touch ring further comprises a plurality of touch portions corresponding to the plurality of direction key portions respectively, and the supporting assembly further comprises a supporting member comprising plurality of elastic hooks engaged with the step portion of the key body and defining a plurality of through holes receiving the plurality of touch portions.

7. The key assembly as claimed in claim 6, wherein the supporting member further comprises at least one fixing post defining a screw hole to match with a screw to fix the supporting member on the PCB.

8. The key assembly as claimed in claim 7, wherein the supporting assembly further comprises a rubber disk located between the supporting member and the PCB, and the at least one fixing post extends through the rubber disk, the switch unit and to the PCB to match with the screw to fix the supporting member on the PCB.

9. The key assembly as claimed in claim 8, wherein the supporting member defines a central hole, and the rubber disk comprises a central convex stage extending from one side of the rubber disk and inserted into the central hole to engage with the center key.

10. The key assembly as claimed in claim 9, wherein the rubber disk further comprises a plurality of first padding blocks corresponding to the plurality of first dome switches respectively, and a second padding block corresponding to the second dome switch, on the other side of the rubber disk.

11. The key assembly as claimed in claim 10, wherein the plurality of touch portions of the touch ring pass through the plurality of through holes of the supporting member and are supported on the rubber disk.

12. The key assembly as claimed in claim 11, wherein the touch ring and the rubber disk are made of elastic rubber material.

13. The key assembly as claimed in claim 12, wherein the supporting assembly further comprises a sliding plate disposed between the touch ring and the circular disk of the key body.

14. The key assembly as claimed in claim 13, wherein the key body is in frictional engagement with the supporting assembly to damp rotation of the key body.

* * * * *